US005144698A

United States Patent [19]

McKenzie

[11] Patent Number: 5,144,698

[45] Date of Patent: Sep. 8, 1992

[54] TOILET SEAT COVER INCLUDING HANDLING MITTS

[76] Inventor: Clancy D. McKenzie, P.S. Box 345, Bala Cynwyd, Pa. 19004

[21] Appl. No.: 663,360

[22] Filed: Mar. 4, 1991

[51] Int. Cl.[5] ..... A47K 13/14

[52] U.S. Cl. ..... 4/245.5; 4/245.7; 4/245.8

[58] Field of Search ..... 4/242-247

[56] References Cited

U.S. PATENT DOCUMENTS

| | | | |
|---|---|---|---|
| 1,304,511 | 5/1919 | Quackenbush | 4/243 |
| 1,358,222 | 11/1920 | Levy | 4/242 |
| 1,524,853 | 2/1925 | Beam | 4/242 |
| 3,263,241 | 8/1966 | Saulson | 4/243 X |
| 4,261,066 | 4/1981 | Belz | 4/242 X |
| 4,806,406 | 2/1989 | Akerman et al. | 4/242 X |

FOREIGN PATENT DOCUMENTS

| | | | |
|---|---|---|---|
| 210513 | 3/1956 | Australia | 4/242 |
| 2023875 | 11/1971 | Fed. Rep. of Germany | 4/244 |
| 2560763 | 9/1985 | France | 4/243 |
| 2587892 | 4/1987 | France | 4/242 |
| 1387994 | 3/1975 | United Kingdom | 4/242 |
| 2208667 | 4/1989 | United Kingdom | 4/244 |

*Primary Examiner*—Henry J. Recla
*Assistant Examiner*—Robert M. Fetsuga
*Attorney, Agent, or Firm*—Eugene Chovanes

[57] ABSTRACT

An improved toilet seat cover is described, comprising an envelope open at one or both ends to permit it to be slipped over a toilet seat to enclose it for sanitary purposes; the cover having a removable central portion which, when removed, forms an opening in the cover coincident with the opening in the toilet seat. The removable central portion when removed includes one or a pair of mitts, for example, to receive and enclose the hand or hands of the user to protect the user from touching any unsanitized surface with a bare hand while opening and closing the toilet enclosure, installing and disposing of the toilet seat cover or flushing the toilet.

6 Claims, 2 Drawing Sheets

TOILET SEAT COVER INCLUDING HANDLING MITTS

FIELD OF THE INVENTION

The present invention relates to the field of personal hygiene and, more particularly, to toilet seat covers for the prevention of disease and to means for the sanitary handling of toilet seats, handles and enclosures.

BACKGROUND OF THE INVENTION

The fear of disease from germs and other infectious matter by personal contact, particularly in public places, has been of concern to many since the concept of germ-spread disease was first known. This has been particularly true concerning public toilet facilities and many means have been suggested to sanitize such facilities and especially toilet seats, including the use of ultraviolet radiation, sanitizing sprays and disposable paper toilet seat covers, among many other means. This problem has become even more worrisome in recent years due to the rise of new or recently recognized diseases, such as herpes caused by a virus, in addition to the long-feared veneral diseases.

PRIOR ART

Due to the long-standing problem of achieving sanitary use of public toilet facilities, many protective toilet seat covers have been developed. In addition to the well-known practice of covering the toilet seat with toilet tissue, dispensers containing shaped paper toilet seat covers have been provided in many public toilets. However, since such paper seat covers are not universally available, other types have been proposed. Among these may be mentioned those described in Quackenbush, U.S. Pat. No. 1,304,511 issued May 20, 1919; Beam, U.S. Pat. No. 1,524,853 issued Feb. 3, 1925; Belz, U.S. Pat. No. 4,261,066 issued Apr. 14, 1981, and particularly Levy, U.S. Pat. No. 1,385,222 issued Nov. 9, 1920.

Saulson, U.S. Pat. 3,263,241 issued Aug. 2, 1966, suggests the use of a polyethylene moisture barrier layer which might be incorporated in the Levy toilet seat cover. It is apparent, however, despite numerous proposals of the prior art, the problem of providing sanitary means for entering and leaving a toilet enclosure, for installing and disposing of a toilet seat protection device, and flushing the toilet, remains unsolved.

It is therefore a primary object of the present invention to provide an improved toilet seat cover which includes means for its installation and removal from the toilet seat in a sanitary manner without the hands of the user touching the toilet seat.

It is another object of the invention to provide sanitary means for disposing of the used toilet seat cover, also without being touched by the hands of the user.

It is another object of the invention to provide a toilet seat cover including means to open and close the door of a toilet enclosure and to flush the toilet without the hands of the user coming into direct contact with any surface previously touched by the public.

It is still another object of the invention to provide an easily portable toilet seat cover which is comfortable and easy to use in a rigorously sanitary manner.

It is yet another object of the invention to provide an inexpensive, easily manufactured toilet seat cover which can be stored in quantity in the home or at the site of use, but also lends itself to being carried in small quantities in a lady's purse or handbag, for example.

SUMMARY OF THE PRESENT INVENTION

The foregoing and other objects of the present invention which will become apparent below, are achieved by providing a toilet seat cover comprising at least one and preferably a pair of removable means to cover the hands of the user while opening and closing a toilet enclosure, installing the seat cover on the toilet seat, handling the toilet flushing mechanism and removing and disposing of the used toilet seat cover. The removable handling means are preferably one or a pair of mitts positioned in the removable center portion of the seat cover. The seat cover itself may suitably be a two-ply or multi-ply envelope, open at one or both ends so that it may be slipped over the toilet seat. The envelope-like seat cover may be composed of any sanitary material such as paper and may include one or more laminated plastic moisture barrier layers. Such plastic barrier layers may be disposed either on the surface of the cover in contact with the upper surface of the toilet seat or intermediate two paper layers. The central portion of the toilet seat cover is removable therefrom to provide an opening coincident, when installed, with the opening in the toilet seat. Any suitable means may be provided to permit removal of the central portion of the toilet seat, such as a perforated or scored and thereby weakened line to permit the central portion to be detached from the remainder of the seat cover. The mitt or mitts may be similarly perforated or scored at the edges to permit them to be detached from the removed seat cover if they are smaller than the entire central portion, but in any case are so scored as to permit separation of the thumb pocket from the finger pocket section of the mitt.

DETAILED DESCRIPTION OF THE INVENTION

The invention will now be described in greater detail in conjunction with the accompanying drawings in which:

FIG. 1 is a plan view of a combined toilet seat cover and handling mitt, all in accord with the invention disclosed. Superimposed in dot-and-dash line is the outline of a conventional toilet seat, illustrating only one form of many. This seat cover is designed to fit most toilet seats.

Figure 1:
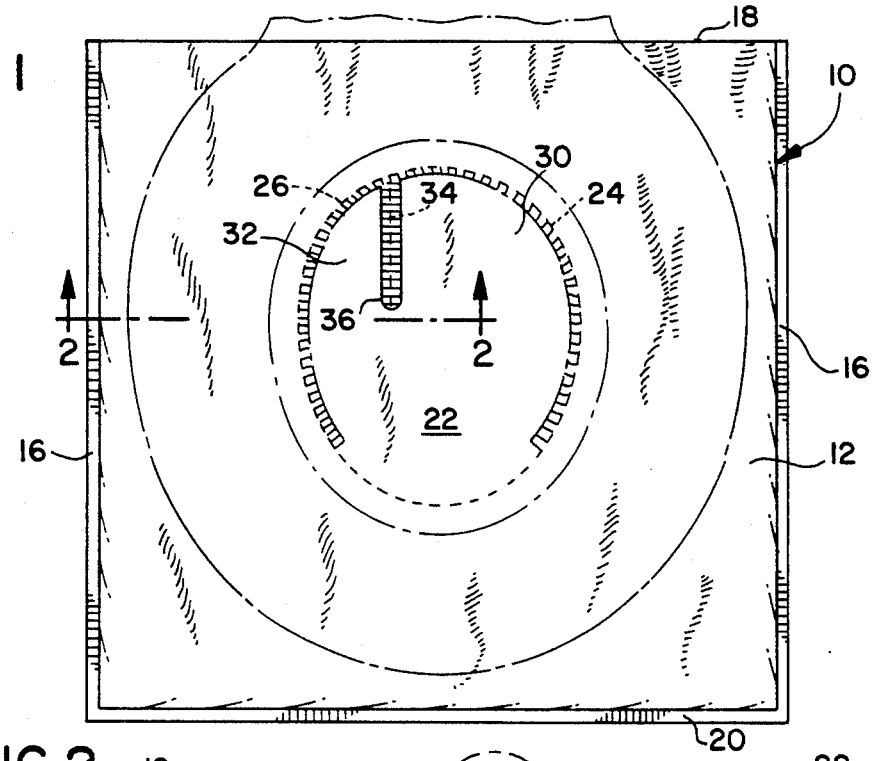

Referring now to the drawings, showing typical embodiments of the invention, a toilet seat cover consisting essentially of an envelope 10, has a top sheet 12 and a bottom sheet 14 suitably closed at the lateral edges 16. The envelope 10 has at least one open rear end 18 and a forward end 20 which may be open or closed. The top and bottom sheets 12 and 14 may be composed of any suitable material such as paper or plastic. In a preferred embodiment, the sheets 12 and 14 are composed of a paper-plastic laminate such as paper-to-polyethylene, with the plastic on the inside. The plastic layer 15, while optional, is highly desirable since it acts as a moisture and vapor barrier, adding to the protection provided by the paper layer. It is desirable for the upper surface of the top sheet 12 to be composed of paper or any other suitable material which is comfortable to the user. The envelope of the toilet seat cover may be a tube with seamless edges 16 or the sheets may be glued, heat-sealed or otherwise closed along the edges 16.

The open end 18 of the toilet seat envelope is dimensioned to fit over the end of any standard toilet seat.

The toilet seat cover 10 has a removable central portion 22 surrounded by weakened, scored or perforated lines 24 in the upper and lower sheets 12 and 14 of the envelope. The central portion 22 is easily removable from the remainder of the toilet seat cover prior to installation to form an opening which, when the seat cover is installed, is coincident with the opening in the toilet seat.

The removable central portion 22, in order to remain an integral unit after removal, has a sealed area 26, preferably peripheral on three sides, in which the top and bottom sheets 12 and 14 are connected suitably by heat fusion, glue or otherwise. The central portion 22 is provided with an open end 28 to permit entry of the user's hand between sheets 12 and 14, thus permitting a central portion 22, when removed, to act as a handling means. In an optional but preferred embodiment, as shown in FIG. 1, the handling means 22 includes two separate, open pocket spaces, one 30 for the fingers and the other 32 for the thumb of the user's hand. The spaces 30 and 32 are divided by a suitably weakened rupture line 34 which may be broken to separate the finger portion from the thumb portion to provide a mitt which facilitates use of the handling means. The top sheet 12 is connected to the bottom sheet 14 by any suitable means such as area 26, in an area 36 between the finger pocket 30 and thumb pocket 32 to maintain the integrity of these pockets after rupture of the line 34 which runs through the sealed area 36.

In use, the toilet seat cover 10 is taken in the hands and the central portion 22 is removed by rupturing the scored or perforated line 24. The central portion 22, which may be in the form of a mitt or simply an envelope, is slipped over the user's hand as a protective covering. The finger and thumb pockets, if present, are separated by rupturing the line 34 between them. The door of the toilet closure, if any, is then opened and the seat cover is slipped over the toilet seat with the protected hand or hands. After use, the protected hand is used to flush the toilet, remove the used seat cover, and open the toilet door. The used seat cover and handling mitt are then discarded in the trash disposal unit. In this way, a public toilet may be used in a rigorously sanitary manner with no contact whatsoever of the user with any unsanitized surfaces.

Figure 2:
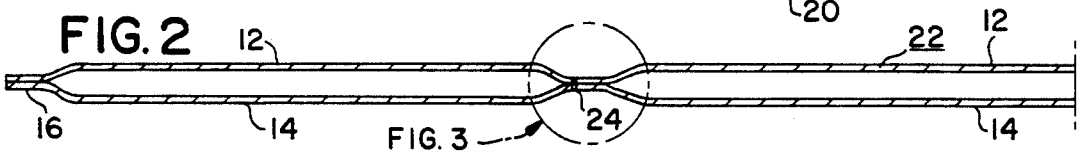
FIG. 2 is an enlarged fragmentary sectional elevational view taken on the line 2,2 of FIG. 1, illustrating certain details of construction.
Figure 8:
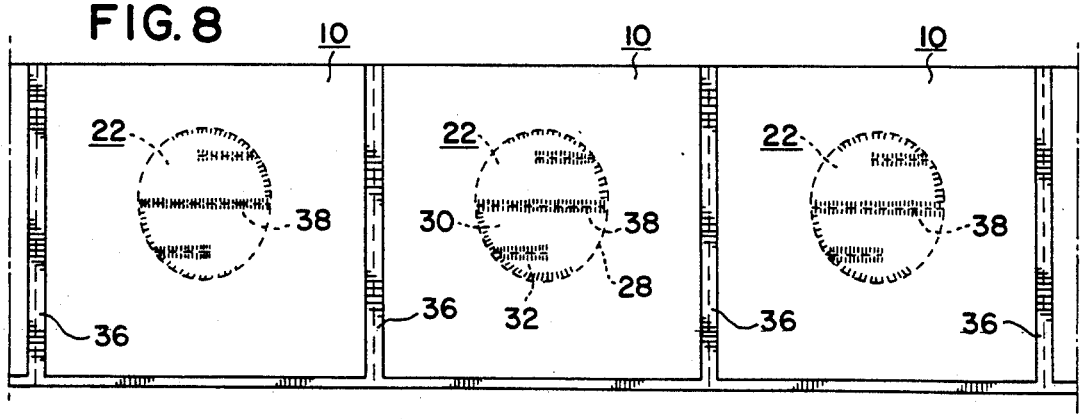
FIG. 8 is a plan view showing a modification of the toilet seat cover shown in FIG. 1, but whose central elliptical portion is designed to produce two handling mitts per toilet cover sheet; the toilet seat cover sheets are joined together in strip form and separated one from another along a scored or perforated edge.

FIG. 8 shows a preferred embodiment of the invention in which a plurality of toilet seat covers are disposed in a strip, as manufactured in quantity, from which an individual seat cover may be detached along the scored or perforated lines 38. The individual toilet seat covers in FIG. 8 are each similar to those shown in FIGS. 1 and 2 and have an envelope or tubular body 10 having upper and lower sheets 12 and 14 and a removable central portion 22. The toilet seat covers in FIG. 8 differ from those in FIGS. 1 and 2 only in that the central portion 22 is formed into a pair of mitts separated by a rupturable line 38. The individual mitts in the embodiment of FIG. 8 are similar to the single mitt in FIG. 1 having open ends 28, finger pockets 30, thumb pockets 32, sealed areas 36 and rupture lines 34.

Figure 3:
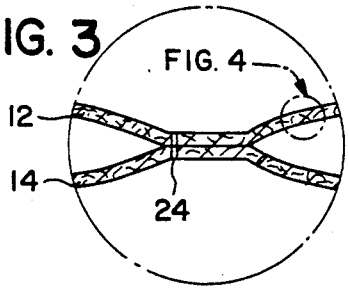
FIG. 3 is a greatly enlarged fragmentary sectional view of the detail enclosed by the dot-and-dash circle shown in FIG. 2 and designated FIG. 3, showing detail of the scoring adjacent a sealed junction.
Figure 4:
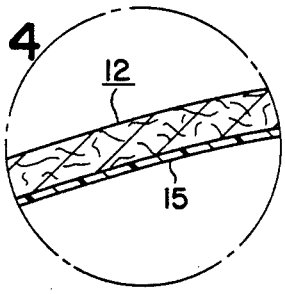
FIG. 4 is another even more enlarged fragmentary sectional view of the detail enclosed within the dot-and-dash circle of FIG. 3 and designated FIG. 4, illustrating a waterproof synthetic layer applied to the inside face of the toilet seat cover.
Figure 5:
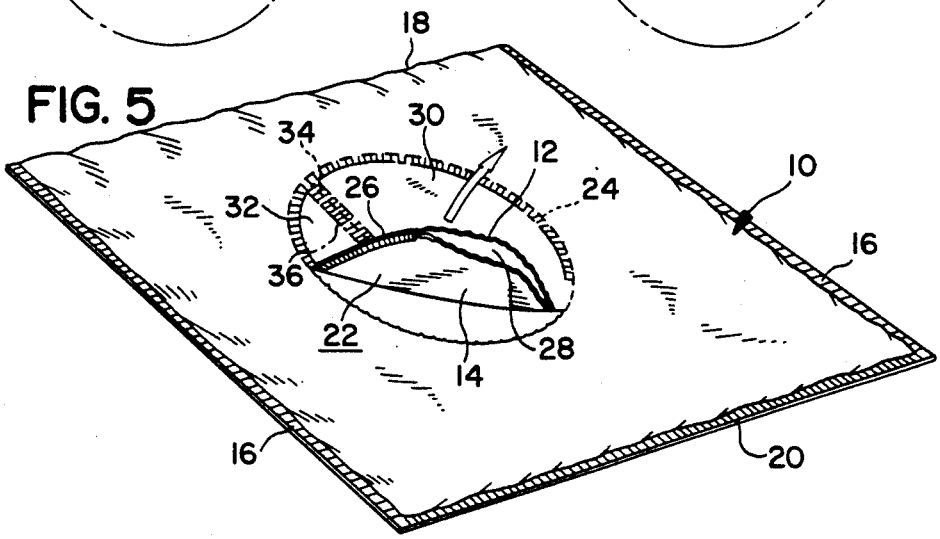
FIG. 5 is a perspective view of the toilet seat cover shown in FIG. 1 with its centrally located, elliptically shaped mitt being removed from the toilet cover sheet forming an aperture in the toilet seat cover and providing a mitt for the user.
Figure 6:
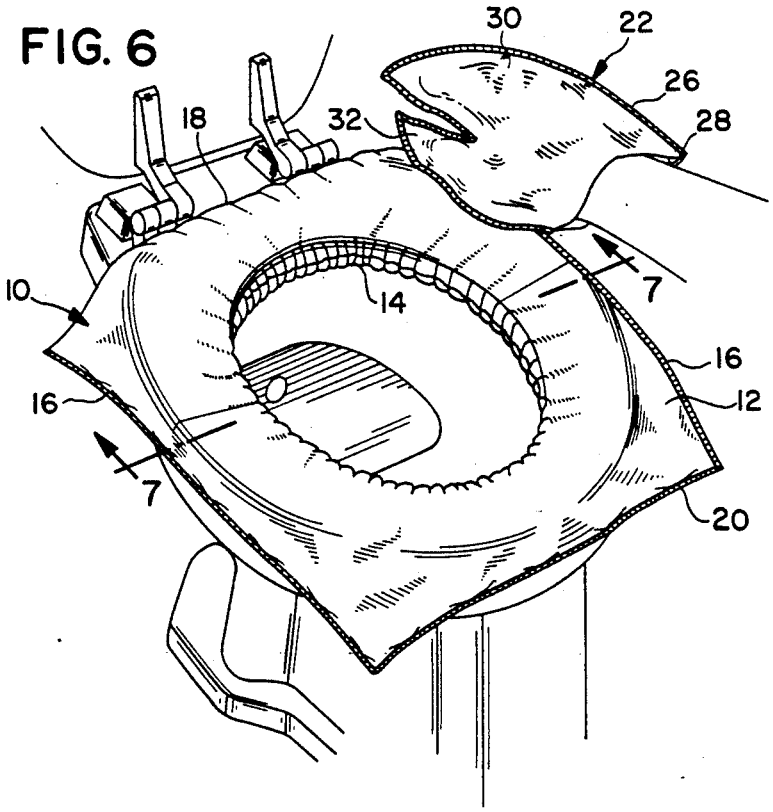
FIG. 6 is a perspective view illustrating a conventional toilet whose seat has been covered by the toilet seat cover of this invention, and the hand of the user encased in the handling mitt.
Figure 7:
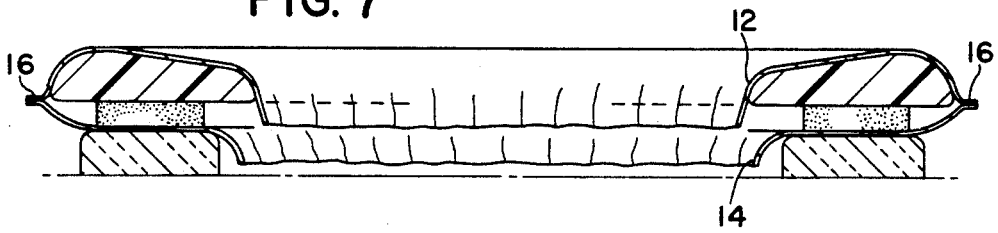
FIG. 7 is an enlarged fragmentary sectional elevational view taken on the line 7,7 of FIG. 6, showing the toilet seat cover in place on a toilet seat.

The convenience of the embodiment of FIG. 3 is obvious, since a desired number of connected seat covers may be rolled up and carried in a handbag; one cover being detached from the roll as needed. Also, the pair of mitts provided by this embodiment adds to the convenience of use in that both hands of the user are available to handle the toilet seat and other surfaces in a sanitary manner.

What is claimed is:

1. In a toilet seat cover comprising an envelope having at least one open end to permit it to be slipped over a toilet seat to enclose the same and having a removable central portion which when removed forms an opening in the toilet seat cover coincidental with the opening in the toilet seat when installed;

the improvement which comprises:

said removable central portion including handling means to receive and enclose at least one of the user's hands, said handling means being in the form of at least one mitten;

whereby said handling means permits the user to perform all functions attendant to the use of a toilet without bare-hand contact with any unsanitized surface.

2. A toilet seat cover of claim 1 in which the handling means comprises a pair of mittens.

3. A toilet seat cover of claim 2 in which each mitten has separable finger and thumb pockets.

4. A plurality of toilet seat covers of claim 2, connected by rupturable lines in a strip of said covers.

5. A toilet seat cover of claim 1 in which said mitten has separable finger and thumb pockets.

6. A plurality of toilet seat covers of claim 1, connected by rupturable lines in a strip of said covers.

* * * * *